US005799637A

United States Patent [19]

Cifuni

[11] Patent Number: 5,799,637

[45] Date of Patent: Sep. 1, 1998

[54] ROCKET EFFECT SPARKING PLUG

[76] Inventor: Charles G. Cifuni, 19 Greenleaf St., Malden, Mass. 02148

[21] Appl. No.: 640,498

[22] Filed: May 1, 1996

[51] Int. Cl.[6] ..... F02B 19/18; H01T 13/54

[52] U.S. Cl. ..... 123/266; 123/169 PA; 123/293; 313/143

[58] Field of Search ..... 123/143 B, 169 R, 123/169 EL, 169 PA, 169 PH, 266, 293; 313/143

[56] References Cited

U.S. PATENT DOCUMENTS

| | | | |
|---|---|---|---|
| 1,295,126 | 2/1919 | Daffron | 313/143 |
| 1,550,897 | 8/1925 | Fonelli | 313/143 X |
| 1,659,037 | 2/1928 | MacDonald | 313/143 X |
| 1,929,748 | 10/1933 | Little | 313/143 |
| 1,930,003 | 10/1933 | Erny | 313/143 |
| 1,945,870 | 2/1934 | Stephenson | 313/143 |
| 2,330,807 | 10/1943 | Berstler | 313/143 |

*Primary Examiner*—Tony M. Argenbright
*Attorney, Agent, or Firm*—Herbert L. Gatewood

[57] ABSTRACT

A spark plug is provided for internal combustion engines in which a tapered chamber or thrust nozzle is provided that terminates at the spark gap. The thrust nozzle is provided with a plurality of openings whereby fuel/air mixture is drawn from the main combustion chamber into the thrust nozzle in contolled flow.

27 Claims, 3 Drawing Sheets

ROCKET EFFECT SPARKING PLUG

BACKGROUND OF THE INVENTION (1). Field of the Invention

This invention relates, in general, to a spark or sparking plug for use in internal combustion engines. More particularly, the invention relates to a spark plug comprising a nonconductive body member terminating in a bottom end having an inverted conical shape and a shell surrounding the nonconductive body member of conductive material which terminates in an elongated, annular-shaped, bottom end in which is provided a plurality of openings. The inner peripheral surface of the bottom end of the shell, in combination with the inverted conical shaped end of the nonconductive member, provides a tapered chamber or thrust nozzle into which fuel/air mixture from the main combustion chamber is drawn via the openings. The flow of the fuel/air mixture through the openings is controlled whereby on spark ignition at the open bottom end of the thrust nozzle the burn zone of the fuel/air mixture is focused. The result is a rocket effect spark ignition.

(2). Background

Spark ignition of an air/fuel mixture within the combustion chamber of an internal engine, in general, involves the igniting of the air/fuel mixture with an electric spark jumped between an electrode provided on the spark, or sparking, plug and a ground electrode also located on the sparking plug. Thus, in general, upon the downward stroke of the piston, the fuel/air mixture enters the combustion chamber from the carburetor, further fuel/air mixture being then blocked off upon completion of the compression stoke, and simultaneously spark is emitted across the spark gap causing combustion of the fuel/air mixture. This combustion and the expanding gases provides the power stroke of the piston.

Over the years, since the invention of the internal combustion engine, there has been an ever continuing quest for the spark plug that will provide the ultimate in performance, e.g., provide better mixing of the fuel and air mixture, better ignition and more uniform and efficient burning in the combustion chamber, etc.

These attempts to provide an improved spark plug have taken many paths. One such solution has been to provide adapters of various constructions for attachment to the spark plug. Thus, for example, in U.S. Pat. No. 4,499,399 there is disclosed an example of a spark plug adapter of the prior art. This spark plug adapter is, in general, an elongated tube having an internal thread pattern at its top end for receiving the threaded end of a conventional spark plug. Within the spark plug adapter there are two chambers, an upper chamber which encompasses the spark plug electrodes and a lower chamber which communicates with the upper chamber via a narrow orifice. The end of the adapter is provided with an external thread pattern whereby the adapter can be threaded into the usual receiving bore of an internal combustion engine. At the open end of the spark plug, there is also provided a deflector element that extends inwardly and perpendicular to the tube wall. In the wall of the adapter, there is provided a plurality of air cooling slots, these being provided lateral to the lengthwise direction of the elongated spark plug adapter. Preliminary combustion, according to the patentee, occurs in the upper chamber of the adapter, the preliminary combustion products being accelerated or jetted by means of the narrow orifice out the lower chamber. This causes a swirling effect, the patentee discloses, resulting in more complete mixture of the preliminary combustion products and with the deflector element the broadest possible dispersion of the fuel/air mixture. The overall result of this, according to the patentee, is a greater and more uniform combustion of the fuel/air mixture.

Another alternative to so-called "spark ignition," and somewhat similar to that disclosed in U.S. Pat. No. 4,499,399, is known in the art as "torch jet-assisted spark ignition." As taught by U.S. Pat. Nos. 3,921,605; 4,924,829; and 5,421,300, this manner of ignition, in general, utilizes a jet of burning gases which is propelled from a precombustion chamber into the main combustion chamber in order to enhance the burning rate within the combustion chamber by providing increased turbulence as well as presenting a larger flame front.

As disclosed in U.S. Pat. No. 5,421,300, the torch jet plug therein is configured to ignite a fuel mixture within a combustion prechamber formed integrally within the body of the spark plug. This is accomplished by a spark gap provided in the prechamber. Thus, during the compression stroke when the prechamber is charged with a fuel/air mixture, this internal spark gap ignites the fuel/air mixture in the prechamber. Because of the small relative volume of the combustion prechamber compared to the main combustion chamber itself, a high pressure is built up in the prechamber while the pressure in the main combustion chamber is still relatively low. According to the patentee, as a result of this difference in pressure, a jet of burning gases which contains an unburned portion of the prechambers's fuel/air mixture is ignited by the external spark gap and shoots from the prechamber far into the main combustion chamber thereby significantly increasing the combustion rate in the main chamber.

In general, the spark plugs disclosed in these patents operate to inject hot byproducts of initial combustion further into the unburned fuel/air mixture in the main combustion chamber. This is done in order to create greater turbulence and to better disperse the flame front in the fuel/air mixture. Nevertheless, it is known that as the flame front travels out from the initial point of spark ignition through the fuel/air mixture, it stretches, thins and cools. These conditions result in varying degrees of misfire, where the flame front extinguishes prior to complete combustion of all the fuel/air mixture present in the combustion chamber. This will result in incomplete combustion and some loss of production of mechanical power.

Another disadvantage found with spark plugs having a combustion prechamber is the fact that some such chambers cannot be completely purged of combustion byproducts during the exhaust of the combustion chamber. This results in reduced jet discharge efficiency with each subsequent firing.

A further undesirable design problem which combustion prechamber spark plugs have is that initial combustion actually occurs inside the prechamber. As the prechamber is located within the body of the spark plug, the combustion in the prechamber results in heat generation directly inside the spark plug. High heat build up in such spark plugs may cause the pre-ignition of the fuel/air mixture and can result in premature failure. This is the reason for the air cooling slots in the spark plug disclosed in U.S. Pat. No. 4,499,399, earlier disclosed.

Thus, there is still a need for a sparking plug for use in internal combustion engines that provides more efficient burning of the fuel/air mixture within the combustion chamber.

SUMMARY OF THE INVENTION

An object of this invention is to provide a spark plug not having the problems and disadvantages of spark plugs now being used in internal combustion engines.

A further object of the invention is to provide a spark plug for internal combustion engines that maintains the flame front in substantially the same location relative to the ignition point of the fuel/air mixture thereby providing more efficient burning of the fuel/air mixture within the combustion chamber.

Another object of the invention is to provide a spark plug for an internal combustion engine that is designed to produce a rocket effect combustion of a fuel/air mixture in a defined burn zone located within the combustion chamber of the internal combustion engine.

Another object of the invention is to provide a spark plug that actively transports fuel/air mixture into a thrust nozzle, the thrust nozzle then discharging the fuel/air mixture to a defined burn zone in the combustion chamber for combustion.

Another object of the invention is to provide a spark plug in which heat build-up on the shell of the spark plug is reduced whereby the potential for pre-ignition is reduced.

Another object of the invention is to provide a spark plug that provides improved performance in an internal combustion engine.

A further object of the invention is to provide a spark plug that provides greater fuel efficiency in an internal combustion engine.

A still further object of the invention is to provide a spark plug that provides better acceleration and smoother engine operation.

A still further object of the invention is to provide a spark plug wherein the fuel/air mixture is delivered to a burn zone where the flame front is held at combustion.

A still further object of the invention is to provide a spark plug in which turbulence of the fuel/air mixture in the combustion chamber is minimized.

A still further object of the invention is to provide a spark plug that combusts more fuel/air mixture in the combustion chamber by drawing it into and through a captured flame burn zone where in a controlled delivery the fuel/air mixture is combusted similar to that in a rocket, resulting in more complete and thorough burning of the fuel/air mixture in the combustion chamber.

Still another object of the invention is to provide a spark plug of simple design and durable construction that provides better performance in an internal combustion engine.

Quite advantageously, combustion with the spark plug of the invention takes place in a burn zone directed away from the body member or shell of the spark plug. This action prevents high heat exposure from occurring on any element of the spark plug. The cooler fuel/air mixture passing through the thrust nozzle of the spark plug of the invention on the way to the burn zone, whereat it is then combusted, helps to maintain the body of the spark plug extending into the combustion chamber at a somewhat lower temperature. Because the combusted gases entering the combustion chamber are already burnt, these gases do not add any great amount of heat to the spark plug body members since, when they do initially enter the fuel/air openings in the thrust nozzle, they operate to extinguish the flame and stop further hot gases from being introduced into the thrust nozzle.

Another advantage of the spark plug of the invention is that it acts to maintain the fuel/air mixture separate from the hot combusted gases by cycling them in a manner that restricts their being mixed together. Thus, the burning of the fuel/air mixture remaining in the combustion chamber is delayed prior to being delivered to the thrust nozzle of the spark plug of the invention. This slow down or delay in the burning of the fuel/air mixture is accomplished, in general, by capturing the flame front in a focused burn zone located directly in front of the discharge end of the thrust nozzle and then metering fuel/air mixture to it in a controlled manner.

Thus, the spark plug of the invention allows for more efficient and thorough fuel consumption to occur. The manner of combustion provided by the spark plug of the invention provides greater efficiency in power generation, this, in turn, providing increased mechanical output on the power stroke of the piston.

BRIEF DESCRIPTION OF THE DRAWINGS

For a better understanding of the present invention, reference should be made to the following detailed description of a preferred embodiment of the invention which is to be read in conjunction with the accompanying drawings, in which.

DETAILED DESCRIPTION OF THE INVENTION AND THE PREFERRED EMBODIMENTS THEREOF

Although the present invention will be described hereinafter with particular reference to the accompanying drawings, it is to be understood at the outset that it is contemplated that the present invention may be varied in specific detail from that illustrated and described herein while still achieving the desirable characteristics and features of the present invention. Accordingly, the description which follows is intended to be understood as a broad enabling disclosure directed to persons skilled in the applicable arts, and is not to be understood as being restrictive.

Figure 1:
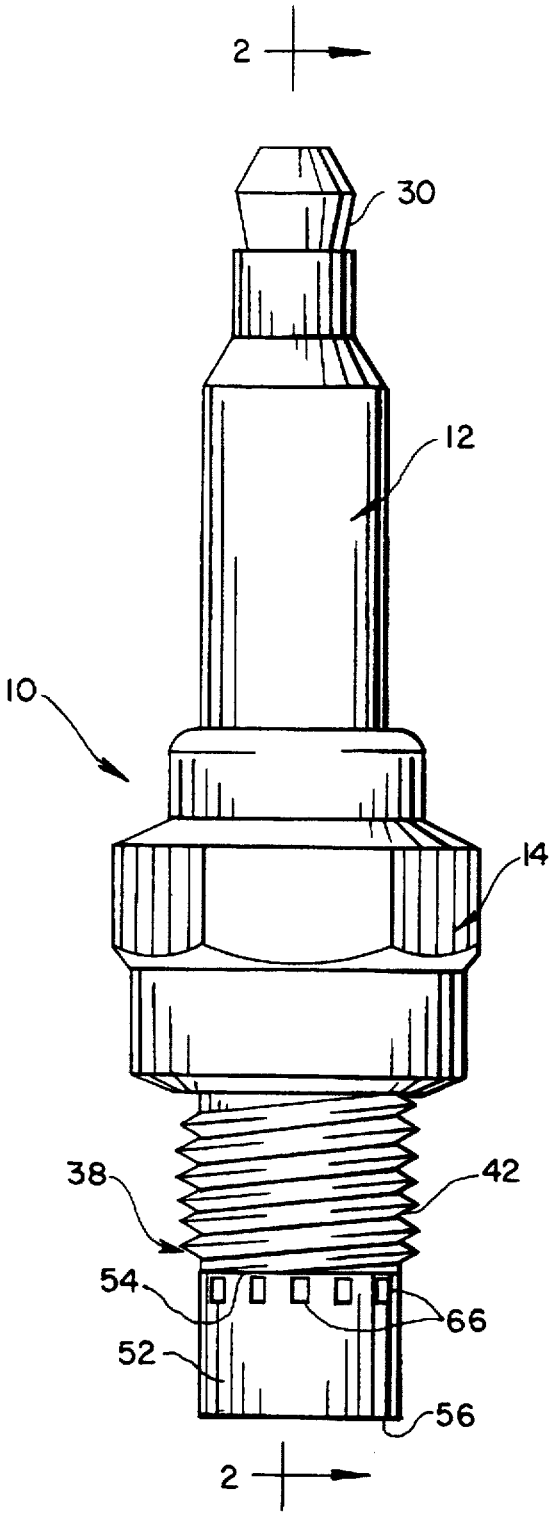
FIG. 1 is a front elevation view of a spark plug according to the invention.
Figure 2:
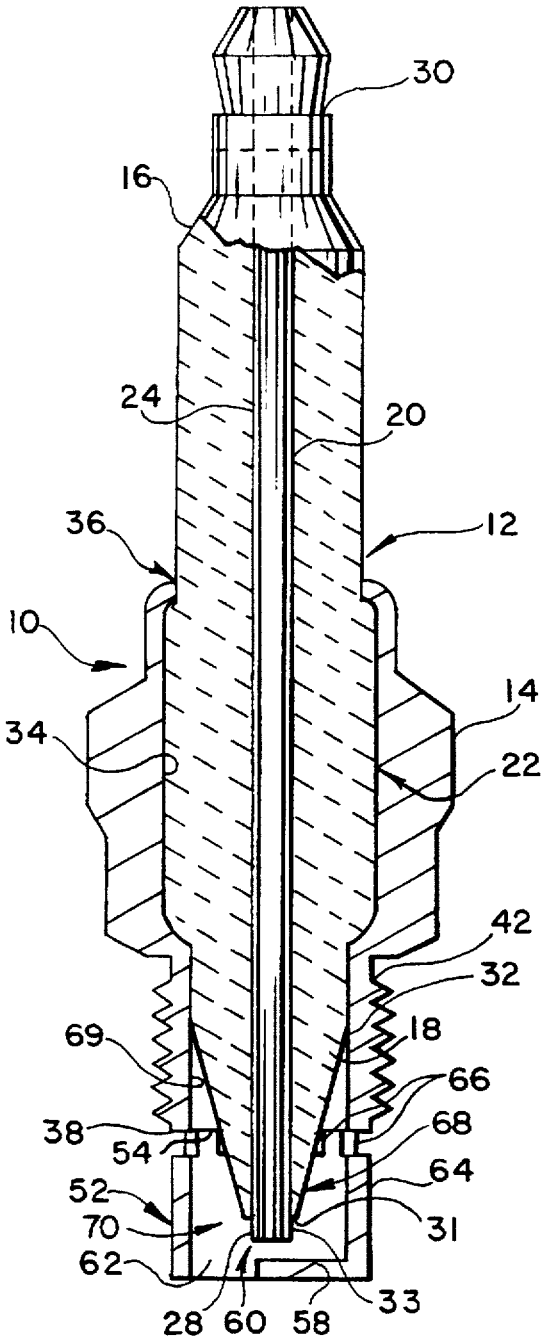
FIG. 2 is a view in cross section of the spark plug shown in FIG. 1, taken at section lines 2—2.

Referring now to FIG. 1, there is shown therein a spark or sparking plug 10 according to the invention. Spark plug 10 comprises an elongated electrically nonconductive body member or insulator 12 surrounded by an electrically conductive body member or shell 14. The elongated nonconductive body member 12 is defined by a top end 16 and a bottom end 18 and an elongated opening 20 that extends from the top end to the bottom end of the nonconductive body member. Body member 12 is defined by a generally circular-shaped outer periphery having a portion 22 thereof between the top and bottom ends of somewhat greater diameter, as seen in FIG. 2. This nonconductive body member or insulator is usually formed from ceramic material such as alumina ($Al_2O_3$); however, it can be made of other materials, if desired. The main thing is that the body member be an insulator or nonconductor.

Located inside the elongated opening is an elongated center electrode or conductor 24 such as conventionally used in spark plugs having a top end 26 and a bottom end 28. The top end of the center electrode extends beyond the top end 16 of the nonconductive body member 12 (FIG. 2) on which is provided a conventional terminal or connector 30, this being connected in usual fashion to a distributor (not shown) whereby an electric current is provided to the spark plug. The bottom end 18 of the nonconductive body member 12, and this is of critical significance to the invention, is in the shape of an inverted cone, i.e. the vertex 31 of the cone extends downwardly as can be seen from FIG. 2. Importantly, the bottom end of body member 12 defines a right circular cone, i.e., its axis is perpendicular to its circular-shaped base 32. Thus, the axis of the cone lies on the centerline of the nonconductive body member 12 and that of the center electrode 24. The vertex 31 of the inverted cone terminates in a flat surface 33 located in a horizontally disposed plane perpendicular to the plane defined by the circular-shaped base. As will be readily appreciated by those skilled in the art, the flat surface 33 and the circular-shaped base 32 are said to be in a horizontal plane only due to the orientation of the figures of the drawings and could be considered to lie in a different plane if differently oriented. As can also be seen from FIG. 2, the bottom end of the center electrode 24 extends beyond the bottom end of the nonconductive body member a predetermined distance, according to usual manner. The elongated center electrode 24 can be of any conductive material, usually of metal, as such is conventional in spark plugs. The center electrode is commonly of circular shape; however, other shapes may also be found satisfactory.

The electrically conductive body member 14 is of a generally tubular shape defining an inner peripheral surface 34 and is defined by a top end 36 and a bottom end 38. The top end 36 of the electrically conductive body member is of a greater internal diameter (FIG. 2) than the bottom end so as to surround and enclose the enlarged portion 22 of the nonconductive body member. At the bottom end 38 of the electrically conductive body member 14 there is provided an external thread pattern to mate with the internal thread pattern of the threaded receiving bore of an internal combustion engine according to usual manner. The body member 14 is crimped to the outer peripheral surface of the nonconductive body member or otherwise fixedly secured thereto, according to conventional techniques.

As is well known to those skilled in the art, the inner peripheral surface of the electrically conductive body member 14 and the outer peripheral surface of the nonconductive body member must be in tight sealing engagement so as to prevent gas leakage between these two body members. This can be accomplished by well known techniques, e.g. suitable temperature resistant material such as copper or soft steel.

The outer peripheral surface of the conductive body member 14 is provided in the shape of a hexagonal nut at the top end according to usual techniques to aid in the installation of the spark plug in the internally threaded bore of a cylinder of an internal combustion engine, later more fully disclosed. The electrically conductive body member 14 of the spark plug of the invention can be provided of metal now commonly used for such purposes.

At the bottom end 38 of the electrically conductive body member 14 there is provided an electrically conductive annular-shaped member 52, the purpose for which will soon be disclosed. The annular shaped member 52 is defined by an open top end and an open bottom or discharge end, as can best be seen from FIG. 2. The inner diameter of the annular-shaped member 52 is seen to be of the same diameter as the inner diameter of the annular-shaped end 38 of the electrically conductive body member 14. The annular-shaped member 52 is provided integral to the bottom end of the electrically conductive body member 14. This can be accomplished, e.g., by machining the body member 14 and annular-shaped body member 52 out of a single piece of metal. On the other hand, the body member and annular-shaped member 52 can be separately made, if desired, and then welded together. Importantly, however, if the two members are welded together, the weld should be tight so that no gas leakage can occur. In the practice of the invention, the inner peripheral surface of the bottom end of the body member 14 and annular-shaped member 52 provide a continuous peripheral surface; however, this may not necessarily be the case for optimum performance. In the drawings, the length of the annular-shaped body member 52, as will be later more fully appreciated, is somewhat exaggerated relative to the bottom end of the conductive body member 14 for purposes of better showing the features of the invention.

An elongated bottom or ground electrode 58 is provided at the bottom end 56 of the annular-shaped member 52, this electrode being provided in horizontal disposition, as disclosed in FIG. 2. The ground electrode 58 is fixedly connected, e.g., by welding, to the bottom end 56 of the annular-shaped member 52 and extends inwardly toward the center thereof. Thus, the free end of the bottom or ground electrode 58 and the bottom end 28 of the center electrode 24 provide a spark gap 60, the ground electrode 58 serving to allow the spark created to be conducted to ground in usual fashion. In the practice of the invention, a conventional spark plug, later more fully disclosed, having an L-shaped ground electrode was modified so that the length of the annular-shaped member 52 would be no longer than the distance between the bottom of the conductive body member and the electrode. This was done so that the modified spark plug would cause no interference in the opening and closing of the valves and the up and down movement of the pistons in a conventional internal combustion engine. More about this later.

The design of the ground electrode should be such as to minimize the creation of turbulence in the gases passing around it during combustion. Turbulence in the gases flowing to the burn zone is undesirable as such will add instability to the flame. Thus, in general, the more aerodynamic the design of the ground electrode 58, the less likelihood that turbulence will be imparted to the gases passing around the electrode.

Although the ground electrode 58 shown in the drawings is connected to the inner peripheral surface of the annular-shaped member 52 and extends perpendicular thereto, as best seen in FIG. 2, an L-shaped ground electrode commonly found in spark plugs may be provided instead, at least in some cases, if desired. The main consideration is that an appropriate spark gap be provided, according to usual techniques. Also the distance that the spark plug extends into the cylinder of the internal combustion engine may be a consideration, as will be later better appreciated.

The annular-shaped member 52 is defined by inner and outer peripheral surfaces 62, 64, respectively. Between the top end 54 and bottom end 56 of the annular-shaped member 52, there is provided a plurality of openings 66, these extending from the outer peripheral surface 64 of the annular-shaped member 52 to the inner peripheral surface 62 thereof. The inverted conical-shaped surface 68 provided at the bottom end 18 of the electrically nonconductive body member 12 and the inner peripheral surface 62 of the annular-shaped member 52, along with the inner peripheral surface 69 at the bottom end of the electrically conductive body member 14, and this is a critical feature of the invention, define an inner tapered cavity 70 (See FIG. 3). Thus, there is provided a thrust nozzle. More about this later.

The electrically conductive body member 14, thrust nozzle and ground electrode can each be of metal conventionally used in spark plugs, e.g., SAE 1008 steel. Those skilled in the art will appreciate, however, that other metals can be used for these elements of the spark plug.

Figure 3:
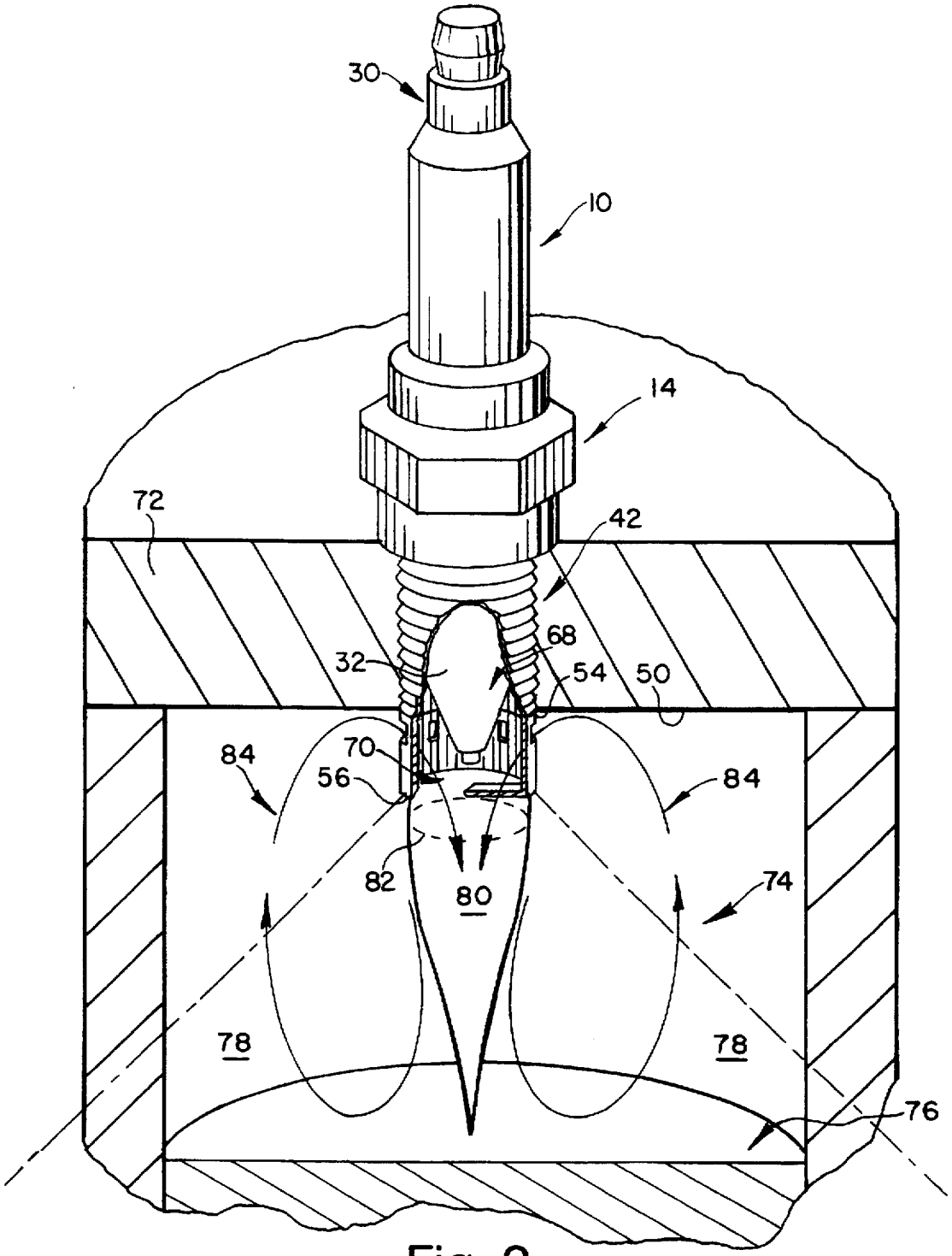
FIG. 3 is a schematic view in partial cross section showing a conventional cylinder and part of the wall of an internal combustion engine with the spark plug of FIG. 1 located in the combustion chamber of the cylinder and a piston in its compression stroke, the flow of the unburned fuel/air mixture into the elongated thrust nozzle via the openings provided therein and the pre-ignited fuel/air mixture out the bottom end of the thrust nozzle to the defined burn zone whereat the fuel/air mixture in the combustion chamber is combusted, the combusted gases then expanding whereby to cause other fuel/air mixture to enter the thrust nozzle through the openings, such flows being shown by the arrows.

The operation of the spark plug 10 of the invention is disclosed in FIG. 3. The spark plug 10 is installed into the cylinder 72 of an internal combustion engine in usual manner. The thrust nozzle or annular-shaped member 52 need be of such a length that the bottom end 56 thereof is located within the combustion chamber 74. Importantly also, the openings 66 provided in the annular-shaped member 52 must be located inside the combustion chamber. In this case, it will be seen that the bottom end of the spark plug, i.e., the bottom of the thread pattern 42, is on the same level as the top or head of the cylinder 50.

The combustion chamber 74 is charged in conventional manner with the usual fuel/air mixture. The fuel/air mixture is then compressed by the piston 76 during the compression stroke of the piston, according to usual operation of the internal combustion engine. As the piston 76 approaches the top of the compression stroke, an electrical charge is provided to the terminal 30 of the spark plug 10 by a distributor (not shown) in conventional manner. The electrical charge passes down the center electrode 24, creating a spark with the ground electrode 58. This spark at the discharge end of the annular-shaped member 52 causes initial spark ignition of the compressed fuel/air mixture present at the discharge end 56 of the thrust nozzle.

Upon initial spark ignition, the combusting gases 84 expand and increase in velocity in the direction of the burn zone 80 shown in FIG. 3, this being the direction of least resistance. Thus, the thrust nozzle gives the combusted gases 78 exhausted from the open bottom or discharge end thereof a rocket-like effect. At the burn zone 80, more of the fuel/air mixture in the combustion chamber 74 is caused to burn, this causing the flame front 82 to develop and, this is of critical significance in the practice of the invention, to be captured at the discharge end 56 of the thrust nozzle. This results by supplying the cooler unburned fuel/air mixture 84 in correctly metered amounts through the openings 66 in the annular-shaped member 52 into the internal tapered cavity or nozzle 70.

At the same time a void or reduced pressure is caused in the internal tapered cavity defined by the bottom conical end of the nonconductive body member and the inner peripheral surface of the annular-shaped member and the bottom end of the electrically conductive body member. This, in turn, causes additional fuel/air mixture 84 to be drawn into the cavity through the openings 66 provided in the annular-shaped member 52. This action is aided by the pressure resulting from the expanding combusted gases 78.

Those skilled in the art will readily appreciate that the performance characteristics of the spark plug of the invention depends upon a number of parameters: (1) the angle of taper of the conical end of the nonconductive body member; (2) the length of penetration of the thrust nozzle into the combustion chamber; (3) the inside diameter of the open bottom end of the thrust nozzle; and (4) the size, shape and location of the openings provided in the annular-shaped member. The optimum parameters can be readily selected by one skilled in the art.

In general, if the fuel/air mixture 84 is supplied through the openings 66 and out the discharge end 56 of the thrust nozzle to the burn zone 80 at the same rate as the fuel/air mixture is being combusted, the flame front position will be maintained in a burn zone located at the discharge end of the thrust nozzle. On the other hand, if the openings 66 supply the fuel/air mixture too quickly to the thrust nozzle, the flame front 82 will be pushed outwardly into the combustion chamber. This is because the fuel/air mixture is coming in through the openings 66 at a rate faster than it can be burned. The flame front, in this case, will be pushed further out into the combustion chamber by the fast moving unburned fuel/air mixture being discharged from the thrust nozzle. As a result, the flame front will then burn the remaining fuel/air mixture in the combustion chamber in the same manner as does a spark ignition system now conventionally used.

Neither is it desirable that the fuel/air mixture be supplied at too slow a rate to the internal cavity of the thrust nozzle. Where this occurs, the flame front will move away from the burn zone as it rapidly consumes the more readily available unburned fuel/air mixture. The expanding flame front will then burn the remaining fuel/air mixture in the combustion chamber in conventional manner.

Thus, the dimensions of the openings 66 provided in the annular-shaped member 52, as well as the number thereof, are of critical importance in the practice of the invention. These parameters are of importance in order that the optimum open area be provided in the annular-shaped member, and the correct amount of fuel/air mixture is metered into the internal tapered cavity defining the thrust nozzle.

In the practice of the invention, a conventional Autolite spark plug (#2545) was modified to provide an annular-shaped member 52 having an inside diameter of 8 mm and a length of 8 mm, the annular-shaped member being of the same inside diameter as the shell of the spark plug. The annular-shaped member 52 was welded at its top end to the bottom end of the electrically conductive body member 14. On being located in the cylinder of an internal combustion engine, as shown in FIG. 3, the entire length of the annular-shaped member 52 extended into the combustion chamber. The conical end of the nonconductive body member had a diameter at the base approximately that of the inside diameter of the annular-shaped member 52. At the base, the cone and inner peripheral surface of the conductive body member are in opposition to one another, the conical surface tapering inwardly at that point approximately 7 degrees. The axis of the cone extends vertically downwardly a distance of 8 mm terminating in a flat horizontally disposed end beyond which the bottom end of the center electrode protrudes. The end of the nonconductive body member terminated 6 mm from the discharge end of the annular-shaped member 52. Thus, the total volume of the internal cavity defined by the tapered surface of the inverted conical-shaped end and the inner peripheral surface of the end of the electrically conductive body member 14 and annular-shaped member is 8 cc.

The annular-shaped member 52 was provided with eight elongated openings, each being of rectangular shape (3 mm×1 mm). The long side of each of the openings extends downwardly toward the bottom end of the thrust nozzle (FIG. 2). The top end of each of the elongated openings 66 is located at the cylinder head. Thus, each elongated opening is located 5 mm upwardly from the open or discharge end of the annular-shaped member 52, and in the same horizontal plane. The area of the open or discharge end of the annular-shaped member provided is 42 mm.

Such a spark plug design according to the invention has been found to give improved performance in a 9:1 compression ratio combustion chamber, compared to the conventional unmodified spark plug without the thrust nozzle provided in combination therewith.

Other like spark plugs were modified to provide an annular-shaped member 52 having 6 and 12 elongated openings. Improved performance was found in spark plugs according to the invention when the total area of the openings provided, and this is of critical importance to the practice of the invention, was in the range of from 20 to 24 millimeters square, keeping the other parameters above-disclosed the same. Nevertheless, as the total open area of the openings is increased or decreased from that range, the fuel efficiency and performance was found to return to that observed in the use of a conventional spark plug, not being modified with the thrust nozzle. Champion spark plugs (RS10LC) modified in accordance with the invention were found to give like results.

Testing of spark plugs according to the invention has been conducted in a 1988, 3.8 Liter V6 Lincoln Continental. Preliminary tests have demonstrated increased fuel efficiencies of approximately 10% compared to the use of conventional, unmodified, spark plugs, as above-identified. This increase in fuel efficiency has been accompanied by a noticeable improvement in performance such as better acceleration and smoother engine operation. Moreover, greater mechanical output is experienced with use of the rocket effect spark plug of the invention. There has been no pre-ignition problems.

Ongoing examination of the spark plugs according to the invention used for over 4,000 miles of continuous duty showed no appreciable difference in appearance from their first introduction into the engine for testing. The spark plugs were tested over a period of 4 months. This lack of change in appearance is a good indicator of proper operation and also suggests long life expectancy Quite advantageously, the cooler fuel/air mixture moving through the openings in the annular-shaped member and through the tapered internal cavity aids in maintaining the thrust nozzle at a temperature below that at which ignition occurs. Thus, pre-ignition of the fuel/air mixture in the cavity is prevented.

Another advantage with spark plugs of the invention is that the fuel/air mixture being rapidly passed through the openings in the annular-shaped member appears to increase atomization. Thus the fuel droplets passing through the openings on the way to the burn zone are broken up and distributed even more thoroughly through the air. Thus, such action will, it is believed, along with having a defined burn zone in which the flame front can remain integral as fuel/air mixture is delivered to it, allow more efficient combustion of lean fuel/air mixtures than has been believed possible heretofore.

The principles by which the void or low pressure zone is created inside the thrust nozzle of the rocket effect spark plug of the invention may be employed in similar fashion to allow the draw of a fuel/air mixture from sources other than the combustion chamber. For example, with some modifications the openings can be designed so that the fuel/air mixture is drawn in directly from the intake manifold.

If desired, means for suppressing electromagnetic interference can be incorporated into the design of the spark plug. This can readily be accomplished by one skilled in the art.

As will be understood by those skilled in the applicable art, various modifications and changes can be made in the invention and its particular form and construction without departing from the spirit and scope thereof. The embodiments disclosed herein are merely exemplary of the various modifications that the invention can take and the preferred practice thereof. It is not, however, desired to confine the invention to the exact construction and features shown and described herein, but it is desired to include all such as are properly within the scope and spirit of the invention disclosed and claimed.

What is claimed is:

1. A spark plug for the controlled burning of a fuel/air mixture at a defined burn zone within the combustion chamber in the cylinder of an internal combustion engine comprising:

(a) an elongated electrically nonconductive body member having a top end and a bottom end, an opening being provided in said body member and extending from said top end to said bottom end;

(b) an elongated electrode defined by a top and bottom end being provided in the opening of said nonconductive body member and extending the length of said opening and beyond the top end and bottom end of said elongated nonconductive body member a predetermined length;

(c) an elongated conductive body being provided in surrounding relationship with the elongated nonconductive body member, said conductive body member being defined by a top end and a bottom end, said top end of the conductive body member being located between the top end and the bottom end of the nonconductive body member, said bottom end of the elongated conductive body member terminating at a predetermined distance below the bottom end of the elongated nonconductive body member and an inner and outer peripheral surface defining the bottom end of the conductive body member;

(d) an external thread pattern being provided on the outer peripheral surface of the elongated conductive body member, said thread pattern being defined by a top end and a bottom end, the bottom end of the thread pattern terminating at the bottom end of the elongated conductive body member;

(e) an elongated annular-shaped member defined by a top end and an open bottom end, and by inner and outer peripheral surfaces, the top end of said annular-shaped member being provided at the bottom end of the elongated conductive body member, a plurality of openings being provided in the annular-shaped member at the top end; and (f) a ground electrode being provided at the bottom end of the annular-shaped member, said around electrode being horizontally disposed and extending inwardly from said inner peripheral surface toward the center of the annular-shaped member and providing a sparking gap with the bottom end of said elongated electrode.

2. A spark plug according to claim 1 wherein the bottom end of the nonconductive body member is in the shape of an inverted truncated cone, said cone being defined by a circular-shaped base in contact with said inner peripheral surface of the conductive body member and a flat, horizontally disposed apex in parallel disposition to the base of the cone, the inverted cone shape of the nonconductive body member at the bottom end of the nonconductive body member defining a thrust nozzle whereby a fuel/air mixture on being combusted is caused to accelerate in the direction of the open bottom end of the annular-shaped member.

3. A spark plug according to claim 2 wherein the annular-shaped member is integrally connected to the bottom end of the electrically conductive body member.

4. A spark plug according to claim 2 wherein said plurality of openings provided in the annular-shaped member each comprises an elongated opening.

5. A spark plug according to claim 4 wherein said plurality of openings each extends lengthwise of the annular-shaped elongated member.

6. A spark plug according to claim 5 wherein said elongated openings are provided in the same horizontal plane.

7. A spark plug according to claim 6 wherein each of said openings is provided in diametric opposition to another of said openings.

8. A spark plug according to claim 5 wherein the total slot area provided by the plurality of elongated openings is in a range of from about 20 to 24 square millimeters.

9. A spark plug for use in internal combustion engines for providing controlled burning of the fuel/air mixture within the combustion chamber comprising:

(a) an elongated conductive body member defined by a top end and a bottom end, an elongated opening being provided in said elongated conductive body member extending from the top end to said bottom end thereby providing an open top end and an open discharge end, said open discharge end of the body member being of annular-shape and defining an outer peripheral surface and an inner peripheral surface;

(b) an external thread pattern being provided on the outer peripheral surface of said conductive body member, said thread pattern being located a predetermined distance up from the discharge end of the elongated conductive body member for threading the spark plug into the threaded spark plug receiving bore of an internal combustion engine, whereby on being threaded into the spark plug receiving bore, the discharge end of the spark plug extends into the combustion chamber a predetermined distance;

(c) a plurality of openings being provided in the annular-shaped bottom end of the elongated conductive body member below the bottom end of the external thread pattern but above the discharge end of the spark plug, said plurality of openings on the spark plug being threaded into the spark plug receiving bore being located in the combustion chamber, said plurality of openings being located in a predetermined distance up from the discharge end of the conductive body member;

(d) an elongated nonconductive body member defined by a top end and a bottom end being located in the elongated opening provided in the elongated conductive body member and being surrounded by the elongated conductive body member, the top end of the nonconductive body member extending beyond the top end of the conductive body member and the bottom end of the nonconductive body member terminating a predetermined distance short of the bottom end of the conductive body member, the bottom end of the nonconductive body member being of an inverted conical shape defined by a circular-shaped base being provided in a horizontally disposed plane and an apex, the apex of said inverted conical shaped end extending downwardly toward the open bottom end of the conductive body member and terminating in a flat surface parallel to the circular-shaped base whereby a tapered internal cavity is provided, said internal cavity providing a thrust nozzle within the bottom end of the conductive body member, said plurality of openings being provided between the circular-shaped base and the bottom end of the elongated conductive body member whereby said plurality of openings are located above the bottom end of the nonconductive body member; and (e) a around electrode being provided at the discharge end of the conductive body member, said ground electrode projecting radially inwardly from the inner peripheral surface of the conductive body member.

10. A spark plug for the controlled burning of a fuel/air mixture at a defined burn zone within the combustion chamber in the cylinder of an internal combustion engine comprising:

(a) an elongated electrically nonconductive body member having a top end and a bottom end, an opening being provided in said nonconductive body member and extending from said top end to said bottom end;

(b) an elongated electrode defined by a top and bottom end being provided in the opening of said nonconductive body member and extending the length of said opening and beyond the top end and the bottom end of said elongated nonconductive body member a predetermined length;

(c) an elongated conductive body member being provided in surrounding relationship with the elongated nonconductive body member, said conductive body member being defined by a top end and a bottom end, said top end of the conductive body member being located between the top end and the bottom end of the nonconductive body member, said bottom end of the elongated conductive body member terminating at a predetermined distance from the bottom end of the elongated nonconductive body member;

(d) an external thread pattern being provided on the elongated conductive body member at the bottom end of said elongated conductive body member, said thread pattern being defined by a top end and a bottom end, the bottom end of the thread pattern terminating at the bottom end of the elongated conductive body member;

(e) an elongated annular-shaped member defined by an open top end and an open bottom end, the top end of said annular-shaped member being provided at and connected to the bottom end of the elongated conductive body member, a plurality of openings being provided in said elongated annular-shaped member, said plurality of openings each comprising an elongated opening; and (f) a ground electrode being provided at the bottom end of the annular-shaped member and providing a sparking gap with the bottom end of said elongated electrode.

11. A spark plug according to claim 10 wherein the bottom end of the nonconductive body member is in the shape of an inverted truncated cone defined by a circular-shaped base and a vertex terminating in a flat surface and lying in a horizontally disposed plane parallel to said circular-shaped base.

12. A spark plug according to claim 11 wherein the inverted cone shape at the bottom end of the nonconductive body member is defined by an axis in perpendicular disposition to a radius of the circular-shaped base whereby a right circular cone is defined.

13. A spark plug according to claim 12 wherein the base of the right circular cone is located between the top and bottom ends of the external thread pattern.

14. A spark plug according to claim 13 wherein the inside diameter of the bottom end of the annular-shaped conductive body member is 8 mm and the diameter of the circular-shaped base of the inverted cone shape at the bottom end of the nonconductive body member is of only a slightly lesser diameter than said inside diameter of the conductive body member, said inverted cone shape defining a taper with said inside diameter of the conductive body member of about 7 degrees.

15. A spark plug for the controlled burning of a fuel/air mixture at a defined burn zone within the combustion chamber in the cylinder of an internal combustion engine comprising:

(a) an elongated conductive body member being defined by a top end and a bottom end, said bottom end of said conductive body member being of annular shape defined by inner and outer diameters and defining an inner peripheral surface and an outer peripheral surface;

(b) an external thread pattern being provided on said outer peripheral surface of the elongated conductive body member, said thread pattern being defined by a top end and a bottom end;

(c) an elongated electrically nonconductive body member having a top end and a bottom end, an elongated opening being provided in said electrically nonconductive body member and extending from said top end to said bottom end, said elongated conductive body member surroundedly engaging the elongated electrically nonconductive body member, the bottom end of said elongated electrically nonconductive body member extending below the bottom end of the elongated conductive body member a predetermined distance, said bottom end of the elongated electrically nonconductive body member being in the shape of a truncated inverted right circular cone defined by a circular-shaped base, said circular-shaped base of said cone being of only slightly lesser diameter than said inner diameter defining the inner peripheral surface of said elongated electrically conductive body member whereby the bottom end of said elongated electrically nonconductive body member diverges inwardly from the inner peripheral surface of said elongated electrically conductive body member;

(d) an elongated electrode defined by a top end and a bottom end being provided in said elongated opening of said nonconductive body member and extending beyond the top end and the bottom end of said elongated nonconductive body member a predetermined length;

(e) an elongated annular-shaped member defined by an open top end and an open bottom end and by inner and outer peripheral surfaces, the top end of said annular-shaped member being provided at and integral to the bottom end of the elongated conductive body member, a plurality of openings being provided in the annular-shaped member, said plurality of openings being located at the top end of the annular-shaped member, said annular-shaped member defining a thrust nozzle for the exit of combusted gases; and (f) a ground electrode being provided at the bottom end of the annular-shaped member and providing a sparking gap with the bottom end of said elongated electrode.

16. A spark plug according to claim 15 wherein the inner peripheral surface of the annular-shaped member and the inner peripheral surface of the elongated conductive body member define a continuous surface.

17. A spark plug according to claim 15 wherein the ground electrode is designed to cause minimal interference with the movement of gases passing out through the exit end of the thrust nozzle during combustion.

18. A spark plug according to claim 17 wherein the ground electrode is of an aerodynamic shape.

19. A spark plug according to claim 15 wherein the plurality of openings comprises eight openings.

20. A spark plug according to claim 15 wherein the distance from the top end of the annular-shaped member to the bottom end thereof is 8 mm and the inner diameter of the annular-shaped member is the same as that of the inner diameter of the conductive body member.

21. A spark plug according to claim 15 wherein the plurality of openings are each of the same area and the combined area of the plurality of openings is from about 20 to 24 millimeters square.

22. A spark plug according to claim 15 wherein the plurality of openings are each of rectangular shape and the long side of the openings extend downwardly toward the bottom end of the annular-shaped member.

23. A spark plug according to claim 22 wherein each of said plurality of openings measures 1 mm×3 mm.

24. A process for providing a focused burn zone in the combustion chamber of an internal combustion engine for the controlled burning of a fuel/air mixture comprising the following steps:

(a) providing a spark plug in the threaded spark plug receiving bore in an internal combustion engine comprising an elongated nonconductive body member, a top end and bottom end defining said nonconductive body member and being in the shape of an inverted right circular truncated cone, an elongated conductive body member defined by a top end and a bottom end being in surrounding engagement with said nonconductive body member, the bottom end of said conductive body member being defined by an inner peripheral surface of circular shape, an elongated electrode being provided lengthwise in the nonconductive body member, said elongated electrode having a top end and a bottom end extending beyond the top and bottom ends of the nonconductive body member, an elongated annular-shaped member defined by a top end and a bottom discharge end being provided at and surrounding the bottom end of the nonconductive body member, a plurality of openings being provided in the elongated annular-shaped member; and a ground electrode being provided at the bottom end of the annular-shaped member whereby to provide a spark gap with the bottom end of said elongated electrode;

(b) introducing a fuel/air mixture into the combustion chamber of the internal combustion engine;

(c) generating a spark at the spark gap whereby to ignite the fuel/air mixture at the bottom end of said annular-shaped member thereby causing the ignited fuel/air mixture to accelerate from the bottom end of the annular-shaped member creating a defined burn zone whereby the fuel/air mixture in the combustion chamber is combusted.

25. A process for providing a focused burn zone in the combustion chamber of an internal combustion engine for the controlled burning of a fuel/air mixture comprising the following steps:

(a) providing a spark plug in the threaded spark plug receiving bore in an internal combustion engine comprising an elongated nonconductive body member, a top end and bottom end defining said nonconductive body member and being in the shape of an inverted right circular truncated cone, an elongated conductive body member defined by a top end and a bottom end being in surrounding engagement with said nonconductive body member, the bottom end of said conductive body member being defined by an inner peripheral surface of circular shape, an elongated electrode being provided lengthwise in the nonconductive body member, said elongated electrode having a top end and a bottom end extending beyond the top and bottom ends of the nonconductive body member, an elongated annular-shaped member defined by inner and outer vertically disposed peripheral surfaces and by a top end and a bottom discharge end being provided at and surrounding the bottom end of the nonconductive body member, a plurality of openings being provided in the elongated annular-shaped member at said top end, said annular shaped member and the conical-shaped bottom end of the nonconductive member providing a cavity in a thrust nozzle; and a ground electrode being provided at the bottom end of the annular-shaped member whereby to provide a spark gap with the bottom end of said elongated electrode, said ground electrode projecting from the inner peripheral surface of the annular-shaped member and extending inwardly;

(b) charging the combustion chamber of an internal combustion engine with a fuel/air mixture;

(c) causing said fuel/air mixture to be compressed;

(d) generating a spark at the spark gap whereby to pre-ignite the fuel/air mixture at the bottom end of said annular-shaped member thereby causing the pre-ignited fuel/air mixture to be combusted whereby the combusted gases expand downwardly into the combustion chamber creating a defined burn zone, said expansion at the same time creating a vacuum in the cavity of the thrust nozzle; and (e) combusting the fuel/air mixture at the burn zone in the combustion chamber thereby creating a flame front at the discharge end of the annular-shaped member, said combusting gases expanding and causing unburned fuel/air mixture to be introduced into the cavity of the thrust nozzle via said plurality of openings.

26. A process according to claim 25 wherein the unburned fuel/air mixture being introduced into the cavity of the thrust nozzle is supplied in metered amounts.

27. A process according to claim 25 wherein the unburned fuel/air mixture introduced into said cavity is supplied at the same rate as the fuel/air mixture being combusted whereby the burn zone is captured at the discharge end of the thrust nozzle.

* * * * *